United States Patent [19]

Stipanuk

[11] 4,091,914

[45] May 30, 1978

[54] WEAR-ACTIVATED RIBBON REINKER

[75] Inventor: Andrew D. Stipanuk, Kenosha, Wis.

[73] Assignee: Porelon, Inc., Cookeville, Tenn.

[21] Appl. No.: 770,494

[22] Filed: Feb. 22, 1977

[51] Int. Cl.[2] ..... B41J 31/14

[52] U.S. Cl. ..... 400/196.1; 400/202.4; 400/208

[58] Field of Search ..... 197/151, 168, 171

[56] References Cited

U.S. PATENT DOCUMENTS

| | | | |
|---|---|---|---|
| 1,988,305 | 1/1935 | Dunn et al. | 197/171 UX |
| 2,645,202 | 7/1953 | Knight | 197/171 X |
| 2,964,157 | 12/1960 | Knight | 197/171 |
| 3,621,968 | 11/1971 | Kondur | 197/168 X |
| 3,831,731 | 8/1974 | Mack et al. | 197/168 |
| 3,887,056 | 6/1975 | Lehmann | 197/168 |
| 3,904,018 | 9/1975 | Denley | 197/168 |
| 4,011,933 | 3/1977 | Kern | 197/151 |

*Primary Examiner*—Ernest T. Wright, Jr.

[57] ABSTRACT

Apparatus for delayed replenishment of marking fluid to a ribbon, characterized by a source of marking fluid adjacent to the ribbon and a wear-actuated device to cause delayed contact of marking fluid with the ribbon. Preferred embodiments include a roller rotatable on an axle and means to apply wear-producing frictional pressure between the roller and axle along one radius such that the roller moves along the radius during wear-producing operation. The frictional pressure may be applied by the ribbon. Other preferred embodiments include an axle and roller of particular configuration, an eccentric mounting of the axle to provide adjustability of the delay interval, and an endless ribbon cartridge.

35 Claims, 7 Drawing Figures

WEAR-ACTIVATED RIBBON REINKER

BACKGROUND OF THE INVENTION

This invention relates to the field of printing ribbon devices and in particular to devices for replenishing marking fluid to a ribbon.

With the recent dramatic growth in the use of automatic printing equipment of various types, including typewriters, computer print-out devices and similar devices, there has been a parallel increased demand for improved printing ribbon equipment. Numerous advances have been made as evidenced by the large number of patents issuing in this field. Considerable technical progress has been made in extending the useful life of a printing ribbon. And, improved printing ribbon cartridges have been developed for the purpose of providing convenient means for changing of printing ribbons. However, there remains a significant need for improvement in printing ribbon devices.

Reinking of a printing ribbon, such as an endless ribbon in a cartridge, has been considered as one means of extending the useful life of the ribbon. Ribbon reinking, however, can lead to difficult technical problems and substantial inconvenience for printing equipment operators. One such technical problem relates to overinking of a ribbon already having sufficient ink for effective printing. Another technical problem relates to unevenness in print darkness upon sudden actuation of a reinking device after an initial period of inactivity. Numerous other related problems are known to those skilled in the art.

This invention addresses each of the aforementioned problems. Broadly described, the invention is a device for replenishing marking fluid to a printing ribbon, characterized by a source of additional marking fluid adjacent the ribbon and wear-actuated means to cause contact of the marking fluid with the ribbon. The invention also includes several specific, advantageous features which will be described in detail.

This invention provides an automatic, delayed and gradual replenishment of marking fluid to a printing ribbon. Such replenishment begins or is accelerated after an initial period of ribbon use and may continue on an increasing basis as use of the ribbon continues.

OBJECTS OF THE INVENTION

A principal object of this invention is to provide a device for replenishing marking fluid to a printing ribbon which overcomes the aforementioned problems and disadvantages.

Another object of this invention is to provide a delayed action, wear-actuated means to replenish marking fluid to a printing ribbon.

Another object of this invention is to provide an endless ribbon cartridge having a substantially longer useful life than previously available comparable ribbon cartridges.

Yet another object of this invention is to provide a ribbon cartridge having ribbon reinking means capable of reinking without causing objectionable unevenness in print darkness.

Still another object of this invention is to provide a ribbon cartridge in which a reinking means is actuated during use without human intervention.

These and other objects will be apparent from the descriptions of preferred embodiments herein and from the drawing wherein:

DESCRIPTION OF PREFERRED EMBODIMENTS

Figure 1:
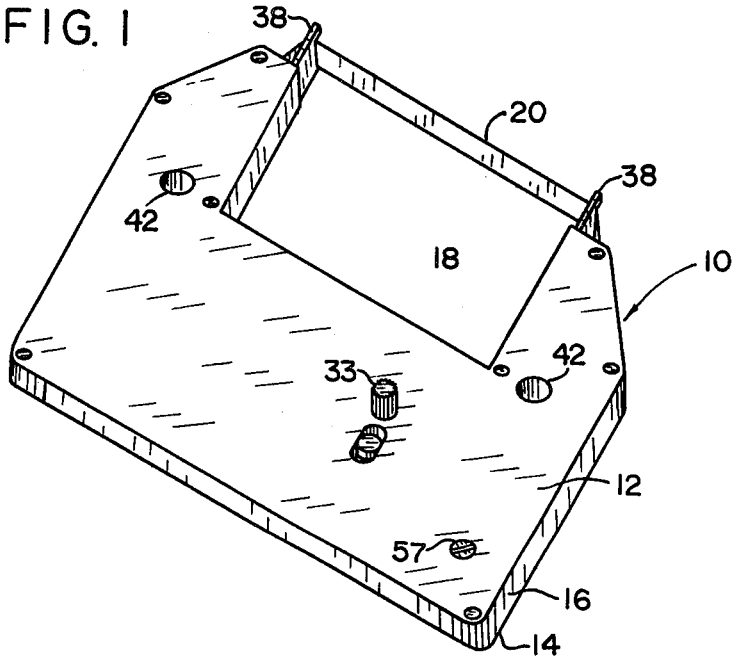
FIG. 1 is a perspective view of an endless printing ribbon cartridge according to this invention.
Figure 2:
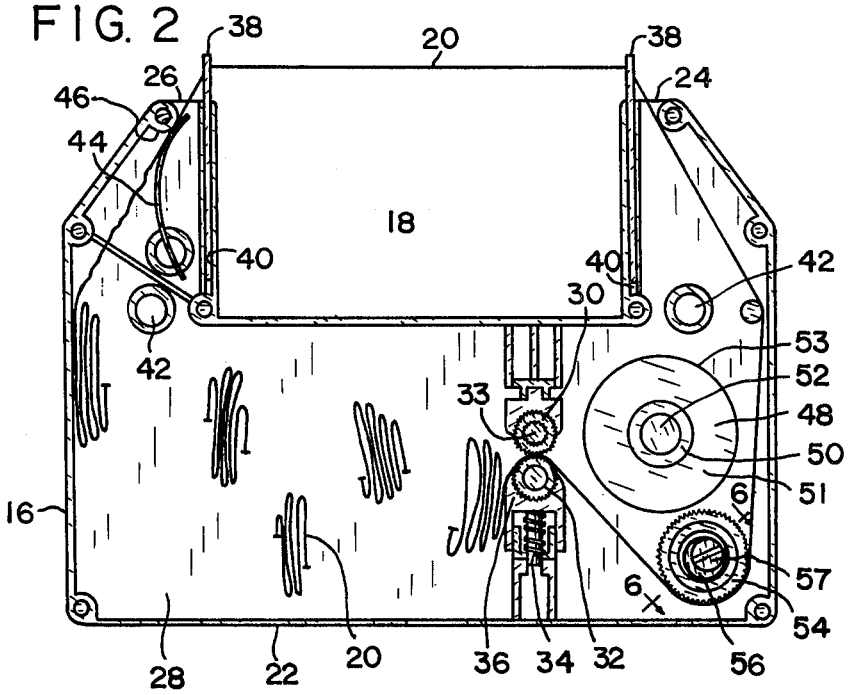
FIG. 2 is a top plan view of the device of FIG. 1, having the cover removed to expose the interior parts.

FIG. 1 shows a preferred printing ribbon cartridge 10 of this invention. Cartridge 10 has two substantially parallel, spaced, major walls, including top wall 12 and bottom wall 14, the edges of which are aligned on opposite edges of side wall 16 which extends about cartridge 10. Cartridge 10 defines a void area 18 which is spanned by a portion of ribbon 20. Void area 18 receives a printing head (not shown) which is part of the printing equipment with which cartridge 10 is used. Ribbon 20 moves across void area 18 during operation to present new sections of ribbon 20 for impingement by elements of the printing head, thus transferring ink from ribbon 20 to, for example, a sheet of paper, all as well known in the art. FIG. 2 shows the working parts of cartridge 10, many of which are well known in the art. Ribbon 20 is an endless loop contained within the case 22, which is formed by walls 12 and 14 of cartridge 10, and looping outside thereof through outlet 26 and inlet 24 which are defined in case 22. Endless ribbon 20 may be an inked, woven, flexible nylon fabric loop of substantial length as is well known in the art. At any given time the bulk of printing ribbon 20 is located in a scramble bin 28 defined within case 22.

Ribbon 20 is pulled from scramble bin 28 through outlet 26 and inlet 24, and subsequently is pushed into scramble bin 28, all by the action of drive rollers 30 and 32. Drive rollers 30 and 32 engage ribbon 20 therebetween in a manner well known in the art. Spring 34 applies pressure to ribbon 20 through roller holder 36 and drive roller 32 to assure adequate advancement of ribbon 20. One of drive rollers 30 and 32 is engaged with a drive shaft which is part of the equipment with which cartridge 10 is used. The drive roller engaging such drive shaft normally has a recess to receive the drive shaft, which in this case is adjacent bottom wall 14 and is therefore not shown. FIG. 1 shows a manual override shaft 33 which allows movement of ribbon 20 by the operator.

Cartridge 10 is provided with adjustable span locators 38 which slide in grooves 40 adjacent void area 18 to adjust the ribbon span thereacross (up or down as shown in FIG. 2) for the purpose of accomodating printing heads of differing dimensions. Span locators 38 may be fixed in grooves 40, by spotwelding or otherwise, once the proper adjustment has been determined and made.

The location of cartridge 10 with respect to the printing equipment, and thus the location of the printing head within void area 18, may be fixed by means of locator holes 42 which receive locator pins (not shown)

forming a part of the printing equipment with which cartridge 10 is used.

As ribbon 20 approaches outlet 26 it is pressed by a leaf spring 44 against a fixed bearing member 46. The engagement of ribbon 20 between leaf spring 44 and bearing member 46 assures that sufficient tension will be maintained in ribbon 20 between outlet 26 and inlet 24 and on to drive rollers 30 and 32. Tension in the ribbon span across void area 18 is highly advantageous for printing, and tension in ribbon 20 between inlet 24 and drive rollers 30 and 32 is important for reasons which will be referred to hereinafter.

Adjacent to scramble bin 28, on the other side of drive rollers 30 and 32, is a device for replenishing marking fluid to ribbon 20, including a cylindrical, porous, rotatable roll 48 which is impregnated with a marking fluid such as ink. Roll 48, which is adjacent to ribbon 20, has a bearing 50 which turns on an axle 52, and an outer, annular, porous portion 51 which contains marking fluid. Porous roll 48 has an outer, peripheral surface 53 from which the marking fluid in roll 48 is expressed, as will be hereinafter described. Axle 52 extends between bottom wall 14 and top wall 12 and is fixed thereto. Porous roll 48 has a width (its axial dimension) which preferably is greater than the width of ribbon 20 and slightly less than the spacing between bottom wall 14 and top wall 12. Porous portion 51 is preferably a polyurethane ink roll of known type impregnated with marking fluids which are known to be suitably releasable from porous roll 48. One such ink roll is marketed under the trademark ACCUFLO by Porelon, Incorporated, Cookeville, Tennessee. Other suitable porous rolls and marking fluids would be apparent to those skilled in the art to whom the invention has been disclosed. In the embodiment shown in FIGS. 1–5, porous roll 48 is free-wheeling on axle 52.

Adjacent to porous roll 48 is a transfer roller 54 which has approximately the same width (axial dimension) as porous roll 48. Ribbon 20 is engaged about transfer roller 54. Transfer roller 54 rotates on axle 56 as ribbon 20 advances by the pull of drive rollers 30 and 32. Axle 56 extends between bottom wall 14 and top wall 12 and, like axle 52, is in fixed position during operation.

Axle 56 has, at its ends, eccentric mounting pins 57, shown in FIGS. 1–5, by which axle 56 is mounted to the major opposite walls 12 and 14. Axle 56 is kept from rotating by tight frictional engagement of pins 57 with walls 12 and 14, but may be turned with a screwdriver or other tool for purposes of adjustment. The eccentric nature of mounting pins 57 causes the main portion of axle 56, and thus transfer roller 54, to move closer to or farther from porous roll 48. By this means, the spacing (usually the initial spacing) of porous roll 48 and transfer roller 54 may be adjusted.

Figure 4:
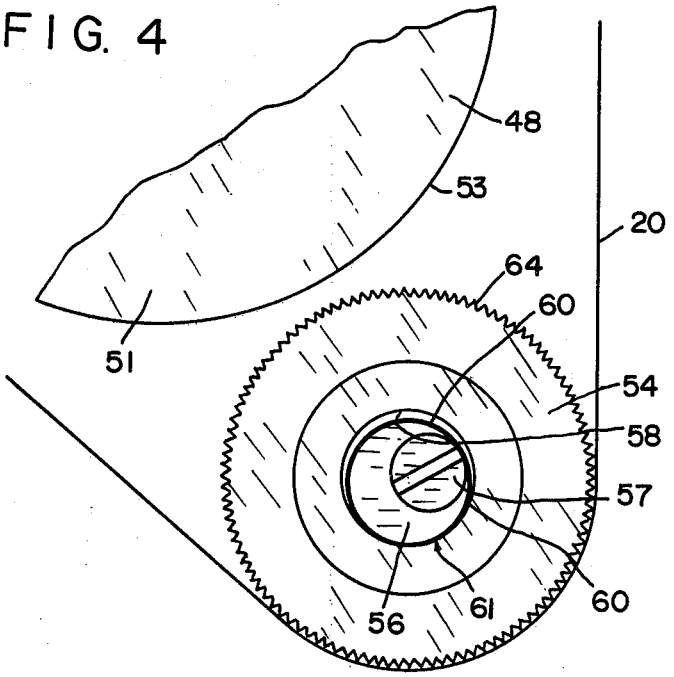
FIGS. 4 and 5 are enlargements of portions of FIGS. 2 and 3, respectively.
Figure 5:
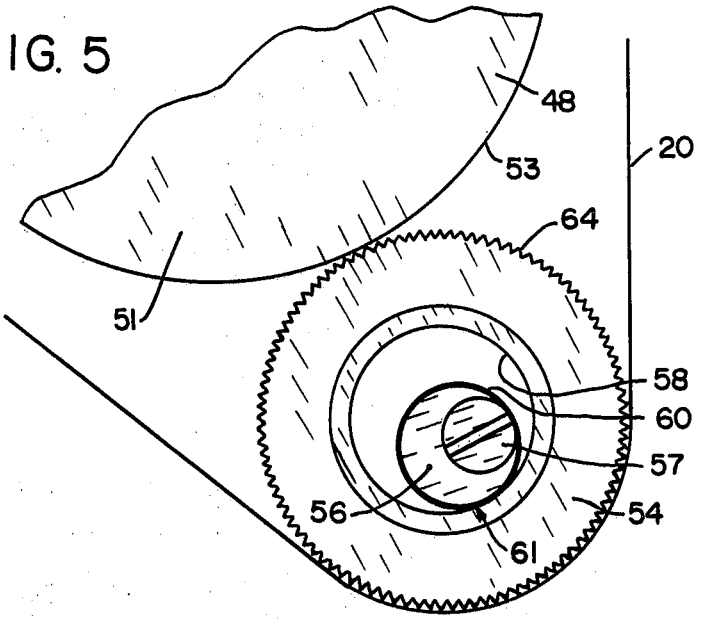

The mechanism of transfer roller 54 and the related structure is best illustrated by the enlargement of FIGS. 4 and 5. Transfer roller 54 has an inner surface 58 formed of wear-susceptible material, which interacts with axle surface 60 of fixed axle 56 as transfer roller 54 turns thereon. Axle surface 60 has an abrasive surface which, when inner surface 58 of transfer roller 54 rotates thereon, wears away the wear-susceptible material on inner surface 58 of transfer roller 54, thus increasing the inner diameter of transfer roller 54 and causing transfer roller 54 to move toward porous roll 48, as will be further described hereinafter.

Abrasive surface 60 may be formed of a wide variety of abrasive grits such as sand, silicone carbide, aluminum oxide, diamond grit and the like. The abrasive grit may be formed on the surface of axle 56, adhering thereto by means of an adhesive. The grit may even be formed on a plastic axle surface as the plastic material is hardened. As an alternative, sand paper, emery cloth, aluminum oxide paper, or an abrasive paper such as that sold by 3M Company, Minneapolis, Minnesota under the trademark TRI-N-ITE, may by sleeved over an axle base member and fixed thereto to form a suitable abrasive surface. The grit size is preferably on the order of about 150 mesh; however, considerable variation is possible. A wide variety of suitable grits or abrasive-surfaced substrates are available and would be apparent to those skilled in the art to whom this invention has been disclosed.

The wear-susceptible material of inner surface 58 of transfer roller 54 is preferably a plastic material susceptible to wear by the grit or other wear-producing means used on axle 56. Polystyrene is a highly preferred material. However, acetal plastics such as that sold by DuPont Company, Wilmington, Delaware under the trademark DELRIN, or acrylic plastics such as that sold by Rohm & Haas, Philadelphia, Pennsylvania under the trademark PLEXIGLAS, are quite suitable. A wide variety of other materials, particularly plastics, would be satisfactory for forming inner surface 58 of transfer roller 54. Such materials would be apparent to those skilled in the art who are familiar with this invention.

Wear-producing frictional pressure between the interacting surfaces 58 and 60 is applied along a radius of axle 56 which is on the line bisecting the angle formed by ribbon 20 as it extends about transfer roller 54. This radius is preferably on a line extending between the fixed center points of axle 56 and axle 52. The earlier mentioned tension applied in ribbon 20 between outlet 26 and drive rollers 30 and 32 serves to provide sufficient loading along the aforementioned radius such that surfaces 58 and 60 interact at point 61, shown in FIG. 4, to wear away inner surface 58 thus causing transfer roller 54 to move along the line including the aforementioned radius, in a direction toward porous roll 48, during operation of cartridge 10.

While it is preferred to use ribbon 20 as a means to apply wear-producing frictional pressure between interacting surfaces 58 and 60, such pressure may be applied by other means. An elastic drive belt, such as O-ring 62 shown in the alternate embodiment of FIG. 7, will apply or increase the wear-producing frictional pressure independently of ribbon 20. Various other suitable spring means would be apparent to those skilled in the art who are familiar with this disclosure.

Figure 3:
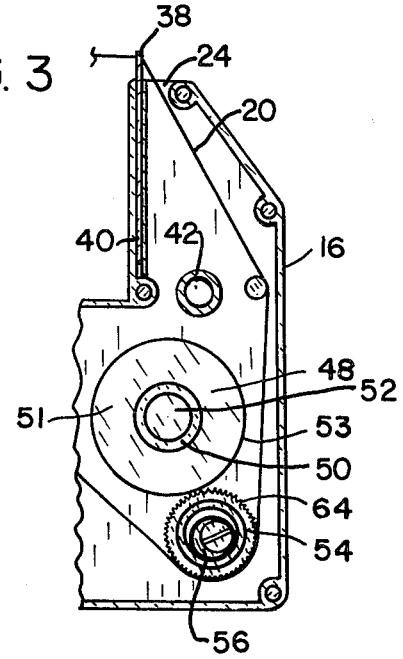
FIG. 3 is a fragmentary top plan view, showing a portion of the device after an initial period of operation.

While FIGS. 2 and 4 illustrate the wear-actuated means before or during the early stages of an initial period of cartridge use, FIGS. 3 and 5 illustrate the same apparatus after an initial period of use. After this period there is sufficient wear on inner surface 58 of transfer roller 54 to cause outer surface 64 of transfer roller 54 to contact peripheral surface 53 of porous roll 48. When such contact is made, the replenishment of marking fluid on ribbon 20 begins.

Outer surface 64 of transfer roller 54 is grooved to provide a firm engagement of printing ribbon 20 therewith and to promote the pick-up of marking fluid from porous roll 48. The physical properties of the surface 64 are also important to outer pick-up and transfer of marking fluid. It is desirable that outer surface 64 have sufficient affinity for the marking fluid to aid in pick-up of marking fluid, but that such affinity not be so strong that release of marking fluid to ribbon 20 is hampered. The plastic materials mentioned above as having suitable wear characteristics for use as inner surface 58 are suitable for transfer of certain marking fluids. Thus, transfer roller 54 may be a single, integral molded or machined part. Alternatively, transfer roller 54 may be made of two layers of material, an inner surface material chosen for its suitable wear characteristics and an outer surface material chosen for its proper interaction with porous roll 48. Suitable materials and marking fluids for all of these purposes will be apparent to those skilled in the art who are familiar with this invention.

After contact is made between peripheral surface 53 of porous roll 48 and outer surface 64 of transfer roller 54, marking fluid is picked up on outer surface 64 and rotates with transfer roller 54 until the marking fluid contacts ribbon 20 as it engages and turns transfer roller 54. As operation continues, the wear on inner surface 58 of transfer roll 54 continues which increases and improves the movement of marking fluid from porous roll 48 to transfer roller 54 and ribbon 20.

Figure 6:
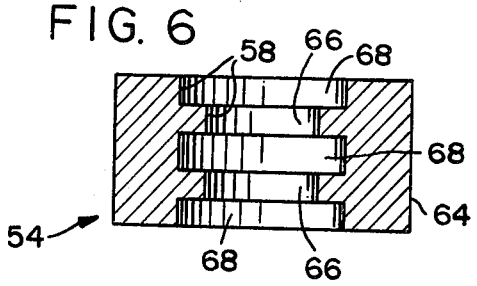
FIG. 6 is an enlarged side sectional view as indicated by Section 6—6 in FIG. 2, including, however, only the transfer roller.

Inner surface 58 of transfer roller 54 preferably includes at least one and most preferably two (or more) raised bearing areas 66 which engage abrasive axle surface 60 of axle 56. FIG. 6 illustrates preferred raised bearing areas 66 which comprise ring-like structures on inside surface 58 of transfer roller 54. Ring-like structures 66 concentrate the radial force applied by ribbon 20 on limited areas of transfer roller 54. This tends to promote greater reproducibility of the rate of wear from one cartridge to another and also provides void spaces 68 which may serve to hold and confine the powder or other scrapings which are produced during the wearing of inner surface 58 of transfer roller 54.

Figure 7:
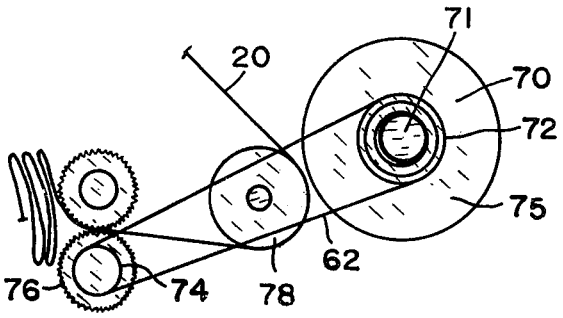
FIG. 7 is a schematic drawing illustrating another embodiment of this invention.

FIG. 7 illustrates schematically an alternate embodiment of this invention in which the roller which moves along a radius during wear is a porous roll 70 containing marking fluid. As previously mentioned, O-ring 62 is used to apply pressure between the interacting surfaces of roll 70 and axle 71 on which it rotates. O-ring 62 extends between pulleys 72 and 74, the former associated with porous roll 70 and the latter associated with a drive roller 76. The outer porous portion 75 of roll 70 may be driven to move, at its common tangent point with freewheeling anvil roller 78, at either the same linear speed or at a differing linear speed from that of anvil roller 78. In some cases, a differing linear speed may improve the transfer (after contact is made) of marking fluid from porous roll 70 to ribbon 20. Or, instead of driving all of roll 70, the porous portion of roll 70 may be made free-wheeling on the pulley-controlled portion thereof such that it would be independent of the movement of O-ring 62 and would move with ribbon 20 and anvil roller 78 when contact is made with ribbon 20.

Materials and configurations other than abrasive grits may be used to produce the wear required in this invention. Blades which shave away a surface interacting therewith and points which cut into a surface interacting therewith are two examples of other suitable wear-producing means. A wide variety of other suitable means would be apparent to those skilled in the art who have read this disclosure. It should also be noted that the abrasive or wear-producing means may be situated on an inner surface of a roller which would rotate on a wear-susceptible axle. In such an arrangement the axle would wear away on one side to produce the desired effect of moving the roller along a given radius line during the wear-producing operation. With this configuration, the operation might be improved by molding annular raised bearing areas about the axle.

The materials useful for construction of the cartridge and for certain moving parts thereof such as the drive rollers are preferably well known plastics readily available from a number of sources. A wide variety of other materials would also be acceptable. The source of marking fluid, while preferably in the form of a roll, could also be in other forms such as pads and the like.

Finally, while this invention is described as embodied in an endless ribbon cartridge, it is equally applicable to ribbon cartridges of other types and to printing ribbon devices other than cartridges.

While in the foregoing specification, this invention has been described in relation to certain preferred embodiments, and many details have been set forth for purpose of illustration, it will be apparent to those skilled in the art that the invention is susceptible to additional embodiments and that certain of the details described herein can be varied considerably without departing from the basic principles of the invention.

I claim:

1. A device for replenishing marking fluid to a ribbon comprising:

a source of marking fluid adjacent said ribbon; and wear-actuated means to cause contact of said marking fluid and said ribbon.

2. The device of claim 1 wherein said wear-actuated means comprises:

an axle;

a roller rotatable on said axle, said axle and said roller having interacting surfaces; and means to apply wear-producing frictional pressure between said interacting surfaces along one radius, whereby said roller moves along said radius during wear-producing operation.

3. The device of claim 2 wherein said ribbon is engaged about said roller.

4. The device of claim 3 wherein said means to apply frictional pressure comprises said ribbon.

5. The device of claim 2 wherein one of said interacting surfaces has an abrasive area and the other interacting surface has a material susceptible to wear by engagement with said abrasive area.

6. The device of claim 5 wherein said other interacting surface includes at least one raised bearing area engaging said abrasive area.

7. The device of claim 6 wherein said at least one bearing area comprises a ring-like structure.

8. The device of claim 5 wherein the abrasive area is on said axle and the axle-engaging surface of said roller includes at least one ring-like raised bearing area engaging said abrasive surface.

9. The device of claim 2 wherein said roller is said source of marking fluid, said roller having at its outer periphery a porous, cylindrical body impregnated with marking fluid.

10. The device of claim 2 wherein said source of marking fluid comprises a porous, cylindrical, rotatable roll adjacent said roller, said porous roll impregnated with marking fluid.

11. The device of claim 10 wherein said ribbon is engaged about said roller, and said roller and roll move into contact during wear-producing operation such that marking fluid from said roll is transferred to said roller and thereby to said ribbon.

12. The device of claim 11 wherein one of said interacting surfaces has an abrasive area and the other interacting surface has a material susceptible to wear by engagement with said abrasive area.

13. The device of claim 12 wherein the abrasive area is on said axle.

14. The device of claim 13 wherein the axle-engaging surface of said roller includes at least one raised bearing area engaging said abrasive surface.

15. The device of claim 14 wherein said at least one bearing area comprises a ring-like structure.

16. The device of claim 15 wherein said ribbon is engaged about said roller.

17. The device of claim 16 wherein said means to apply frictional pressure comprises said ribbon.

18. A ribbon cartridge comprising:

a case having substantially parallel, spaced major walls, said case defining an inlet and an outlet;

an endless ribbon within said case and looping outside thereof through said inlet and outlet;

a source of marking fluid within said case adjacent a portion of said ribbon; and wear-actuated means to cause contact of said marking fluid and said ribbon portion.

19. The ribbon cartridge of claim 18 wherein said wear-actuated means comprises:

an axle extending between said major walls;

a roller rotatable on said axle, said axle and said roller having interacting surfaces; and means to apply wear-producing frictional pressure between said interacting surfaces along one radius, whereby said roller moves along said radius during wear-producing operation.

20. The ribbon cartridge of claim 19 wherein said ribbon is engaged about said roller.

21. The ribbon cartridge of claim 20 wherein said means to apply frictional pressure comprises said ribbon.

22. The ribbon cartridge of claim 19 wherein one of said interacting surfaces has an abrasive area and the other interacting surface has a material susceptible to wear by engagement with said abrasive area.

23. The ribbon cartridge of claim 22 wherein the abrasive area is on said axle.

24. The ribbon cartridge of claim 23 wherein the axle-engaging surface of said roller includes at least one raised bearing area engaging said abrasive surface.

25. The ribbon cartridge of claim 24 wherein said at least one bearing area comprises a ring-like structure.

26. The ribbon cartridge of claim 19 wherein said axle has an eccentric mounting to said major walls for rotational adjustment thereby allowing radial adjustment of the position of said axle.

27. The ribbon cartridge of claim 19 wherein said roller is said source of marking fluid, said roller having at its outer periphery a porous, cylindrical body impregnated with marking fluid.

28. The ribbon cartridge of claim 19 wherein said source of marking fluid comprises a porous, cylindrical roll journaled between said major walls, said porous roll impregnated with marking fluid.

29. The ribbon cartridge of claim 28 wherein said ribbon is engaged about said roller, and said roller and roll move into contact during wear-producing operation such that marking fluid from said roll is transferred to said roller and thereby to said ribbon.

30. The ribbon cartridge of claim 29 wherein said means to apply frictional pressure comprises said ribbon.

31. The ribbon cartridge of claim 30 wherein one of said interacting surfaces has an abrasive area and the other interacting surface has a material susceptible to wear by engagement with said abrasive area.

32. The ribbon cartridge of claim 31 wherein the abrasive area is on said axle.

33. The ribbon cartridge of claim 32 wherein the axle-engaging surface of said roller includes at least one raised bearing area engaging said abrasive surface.

34. The ribbon cartridge of claim 33 wherein said at least one bearing area comprises a ring-like structure.

35. The ribbon cartridge of claim 34 wherein said axle has an eccentric mounting to said major walls for rotational adjustment of the position of said axle.

* * * * *